US011873159B2

(12) United States Patent
Steele

(10) Patent No.: US 11,873,159 B2
(45) Date of Patent: Jan. 16, 2024

(54) PACKAGE HAVING A HINGEABLE VALVE MECHANISM

(71) Applicant: Mark Steele, New Prague, MN (US)

(72) Inventor: Mark Steele, New Prague, MN (US)

( * ) Notice: Subject to any disclaimer, the term of this patent is extended or adjusted under 35 U.S.C. 154(b) by 0 days.

(21) Appl. No.: 17/406,495

(22) Filed: Aug. 19, 2021

(65) Prior Publication Data

US 2022/0055826 A1 Feb. 24, 2022

Related U.S. Application Data

(60) Provisional application No. 63/067,457, filed on Aug. 19, 2020.

(51) Int. Cl.

| | |
|---|---|
| ***B65D 85/73*** | (2006.01) |
| ***B65D 75/00*** | (2006.01) |
| ***B65D 77/22*** | (2006.01) |

(52) U.S. Cl.

CPC ..... *B65D 85/73* (2013.01); *B65D 75/008* (2013.01); *B65D 77/225* (2013.01)

(58) Field of Classification Search

CPC ..... B65D 85/73; B65D 75/008; B65D 77/225
USPC ..... 383/100
See application file for complete search history.

(56) References Cited

U.S. PATENT DOCUMENTS

| | | | | |
|---|---|---|---|---|
| 2,665,033 | A | | 1/1954 | Robertson |
| 3,217,934 | A | | 11/1965 | Schneider et al. |
| 3,224,640 | A | | 12/1965 | Schneider et al. |
| 3,278,085 | A | | 10/1966 | Brown |
| 3,439,864 | A | * | 4/1969 | Kasting ..... B65D 31/08 383/126 |
| 3,642,189 | A | | 2/1972 | Widenback |
| 3,815,810 | A | | 6/1974 | Wellman |
| 4,163,509 | A | | 8/1979 | Amneus |
| 4,712,249 | A | * | 12/1987 | Gannon ..... B65D 81/2038 383/45 |
| 5,142,970 | A | * | 9/1992 | ErkenBrack ..... A23L 3/3418 206/524.8 |
| 5,228,782 | A | | 7/1993 | Imer |
| 5,547,284 | A | | 8/1996 | Imer |
| 5,863,131 | A | | 1/1999 | Nakamura |
| 7,040,810 | B2 | | 5/2006 | Steele |
| 7,207,717 | B2 | | 4/2007 | Steele |
| 7,537,387 | B2 | | 5/2009 | Spork et al. |
| 8,540,427 | B2 | | 9/2013 | Steele |

(Continued)

FOREIGN PATENT DOCUMENTS

| | | |
|---|---|---|
| WO | 2016044812 A1 | 3/2016 |
| WO | 2018075992 A1 | 4/2018 |

*Primary Examiner* — Peter N Helvey
(74) *Attorney, Agent, or Firm* — Skaar Ulbrich Macari, P.A.

(57) ABSTRACT

A flexible and hingeable valve mechanism is provided to a package or pouch, e.g., a package top seal, creating one or more channels through the top seal of the pouch and then, approximate to the one or more channels, making or forming a pocket within the same seal. As the pocket is filled with gas, it can prevent the top seal from accidentally kinking and allow other gas pressure to flow freely through the one or more channels. If the pouch is tilted or tipped over, the pocket will fill with the liquid content of the pouch and the weight of the liquid within the pocket will cause the pocket to hingeably displace and close off at least a portion of the one or more channels to prevent leaking or spilling.

20 Claims, 12 Drawing Sheets

(56) References Cited

U.S. PATENT DOCUMENTS

| | | | | |
|---|---|---|---|---|
| 8,613,547 | B2 | 12/2013 | Steele | |
| 9,309,036 | B2 | 4/2016 | Steele et al. | |
| 9,376,247 | B2 | 6/2016 | Dodd | |
| 9,376,249 | B2 | 6/2016 | Steele et al. | |
| 9,963,284 | B2 | 5/2018 | Steele | |
| 10,329,053 | B2 | 6/2019 | Steele | |
| 10,427,851 | B2 | 10/2019 | Steele et al. | |
| 10,913,590 | B2 | 2/2021 | Steele | |
| 10,988,295 | B1 | 4/2021 | Ludwig | |
| 11,014,718 | B2 | 5/2021 | Ludwig | |
| 11,130,617 | B2 | 9/2021 | Ludwig et al. | |
| 11,214,416 | B2 | 1/2022 | Ludwig et al. | |
| 11,350,802 | B2 | 6/2022 | Steele | |
| 11,370,584 | B2 | 6/2022 | Ludwig et al. | |
| 11,505,383 | B2 | 11/2022 | Steele | |
| 2003/0066267 | A1* | 4/2003 | Nelson | B65D 33/255 53/434 |
| 2005/0233035 | A1* | 10/2005 | Smith | B65D 81/3453 426/118 |
| 2006/0228057 | A1* | 10/2006 | Newrones | B31D 1/026 383/103 |
| 2008/0056623 | A1 | 3/2008 | Shubilla | |
| 2009/0180716 | A1 | 7/2009 | Steele | |
| 2010/0226600 | A1 | 9/2010 | Steele | |
| 2011/0075954 | A1 | 3/2011 | Kumar et al. | |
| 2011/0103714 | A1 | 5/2011 | Steele et al. | |
| 2011/0182531 | A1 | 7/2011 | Steele | |
| 2012/0074002 | A1 | 3/2012 | Steele et al. | |
| 2015/0197379 | A1 | 7/2015 | Otsuka et al. | |
| 2015/0251831 | A1 | 9/2015 | Steele | |
| 2017/0307091 | A1* | 10/2017 | Branyon | B65D 77/225 |
| 2018/0370673 | A1* | 12/2018 | Taruno | B65D 1/0246 |
| 2020/0130899 | A1 | 4/2020 | Ludwig et al. | |
| 2021/0347536 | A1 | 11/2021 | Ludwig et al. | |
| 2022/0041338 | A1 | 2/2022 | Steele et al. | |

* cited by examiner

PACKAGE HAVING A HINGEABLE VALVE MECHANISM

PRIORITY

This application claims priority to and the benefit of U.S. Provisional Patent Application No. 63/067,457, filed Aug. 19, 2020, which is fully incorporated herein by reference.

FIELD

The present invention relates generally to packaging and, more particularly, to packages, and methods for manufacturing and using packages, having a hinging valve mechanism.

BACKGROUND

More and more people are ordering take-out or delivery food service. Some pick up the food and some have it delivered to their home, work, or gathering. Delivering the food product can present issues, such as keeping it hot/cold and fresh. Soda, on the other hand, has other issues often preventing it from getting to the destination as intended.

Carbonated drinks that come from a soda fountain or other means, gas off, especially as they start to warm up. When bouncing around during travel, e.g., in a vehicle, the carbonation can come out of the liquid even faster, building up an excessive amount of pressure within the container that can cause the container to expand, rupture, or explode. This is typically addressed by providing the carbonated drink in a heavy-duty container that can withstand the internal pressure that builds up as the carbonation escapes the liquid. Unfortunately, these heavier containers are not very environmentally friendly and are, therefore, not an ideal solution.

Flexible pouches, especially those made from recyclable, compostable, or biodegradable materials, would be the most beneficial. However, they are not typically heavy enough to handle the inside pressure created from the gassing off of the carbonation. There have been attempts to still use flexible packages made of different plastics or other flexible materials, but in order to keep them from exploding as the pressure builds up, they have a rigid pressure relief valve sealed into the pouch, typically near the top. The valves are not only expensive, but the applying of these structures to the pouch further increases costs and manufacturing complexity. These solutions are also not typically recyclable, compostable, or biodegradable. The rigid valves do work, when placed near the top of a pouch, such that as the pressure from the gas builds up, it is released through the valve so the pouch does not explode. The rigid valves are also designed so that if the pouch were to tip over in transit, the liquid does not leak out through them, or only a minimal amount may leak out. Of course, when the liquid is up against these valves, they no longer work to release the gas either.

As a result, there is a need for a package that substantially solves the above-referenced problems with conventional package designs, configurations, and manufacturing methods, wherein the pouch or package does not include an expensive and non-biodegradable rigid valve.

SUMMARY

Embodiments of the present invention include a pouch or package (e.g., flexible package) having a flexible and hingeable valve mechanism. The present invention provides a solution to conventional packages and methods by using both the gas and the liquid, with one or more channels within the seal (or other region) of a pouch allowing the gas to escape when pressure builds up, and yet close off if the package is tipped over so liquids cannot escape through the same channels.

The present invention can include a hingeable valve provided to a package or pouch, e.g., a package top seal, creating one or more channels through the top seal of the pouch and then, proximate to the one or more channels, making or forming a pocket within the same seal, or proximate the seal area, which is cut or otherwise defined around both sides. This results in the pocket hinging, thereby providing a working valve that will not leak. When the pouch is filled with carbonated product and sealed shut, the gas can start to migrate out of the liquid and into the top of the pouch. The gas, being lighter than liquid or air, will go to the top of the pouch and fill the pocket that was formed in the top seal. As the pocket is filled with gas, it can help prevent the top seal from accidentally kinking and allow other gas pressure to flow freely through the one or more channels that were created within the top seal and located in proximity to the pocket. If the pouch is accidentally tipped over, the pocket will fill with the liquid content of the pouch and the weight of the liquid within the pocket will cause it to fall out of the seal on the hinge, which in turn will kink the one or more channels in the seal near the pocket. Once the one or more channels are kinked, the liquid will be prevented from passing through or leaking out of the pouch.

In various embodiments, the valve mechanism can be included on a side of the package, at the bottom, intermediate the bottom and top, or at any other portion of the package. In addition, the valve mechanism can be included in a non-sealed portion of the package.

In addition to the hinged pocket and the one or more channels described above, different shaped and sized areas in proximity to the pocket and channels can be made or formed to further help the ease in which the film kinks at the channels. Slits, holes, shaped features, etc. in select areas of the seal proximate to the pocket or channels can also assist with the kinking process when desired.

In various embodiments, the hingeable valve can be formed or made separately and then added to a portion of the package, such as the top seal area.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 1:
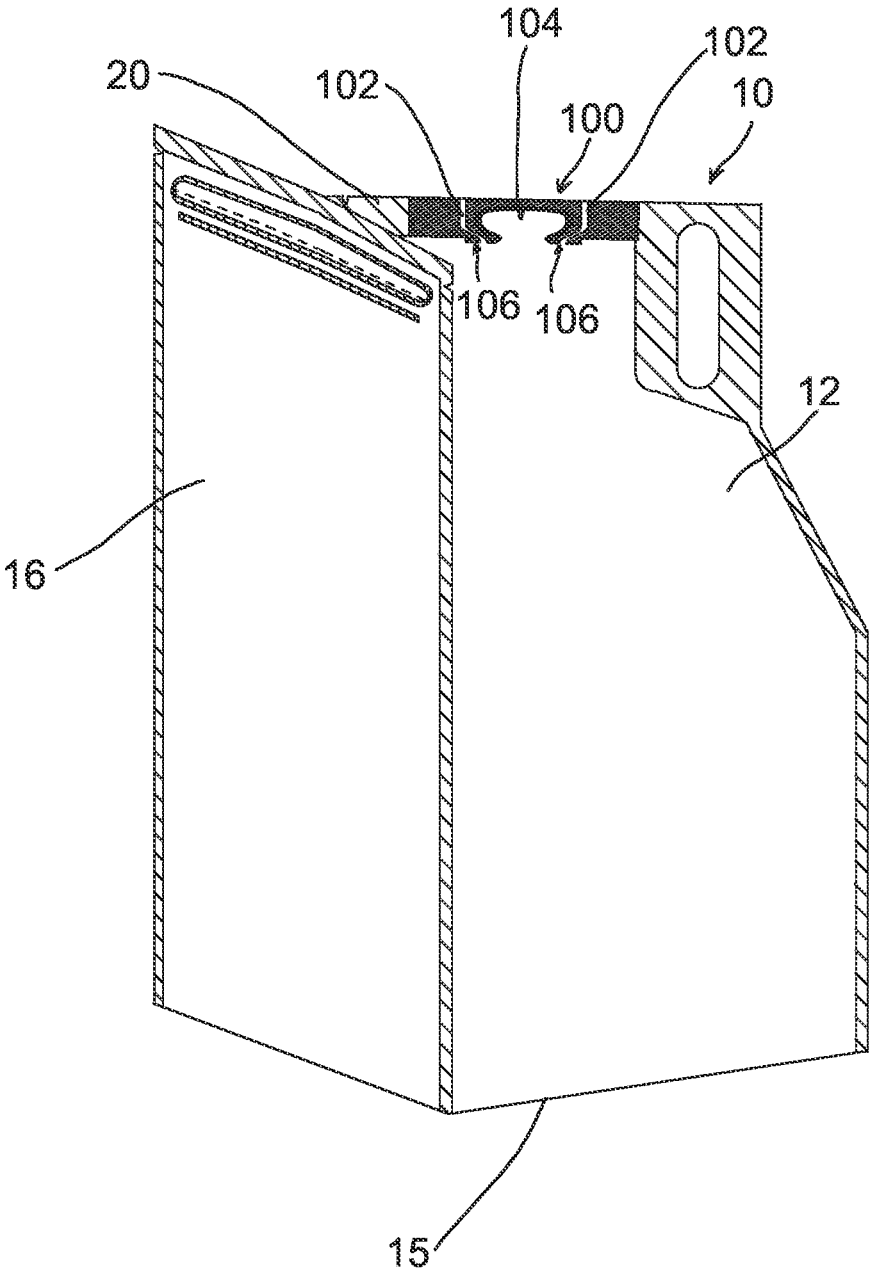
FIGS. 1-3 show a package having a hingeable valve mechanism in a top seal region, in accordance with embodiments of the present invention.
Figure 2:
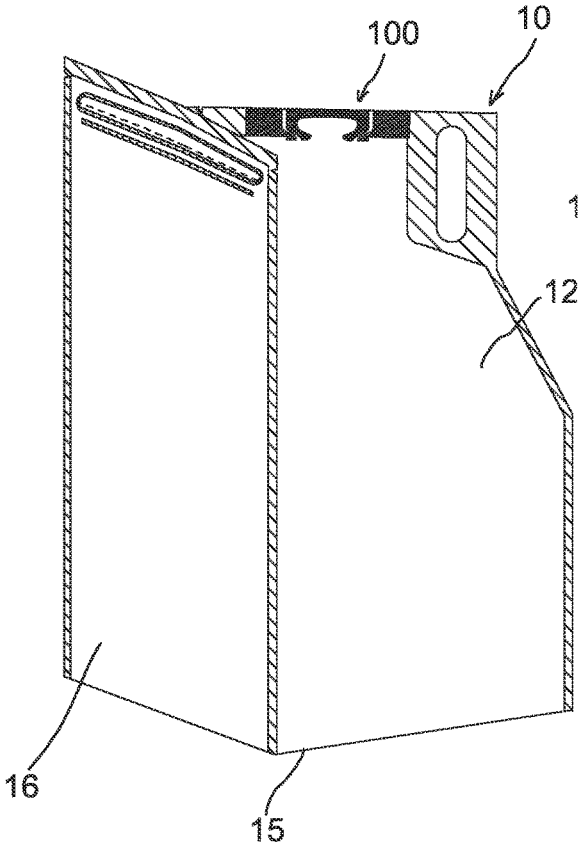
Figure 3:
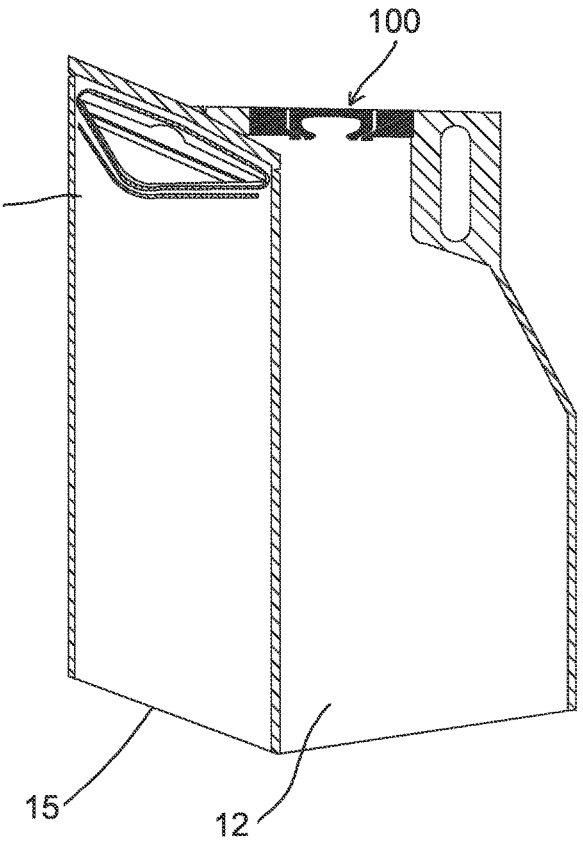

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims. For illustrative purposes, hatching or shading in the figures is generally provided to demonstrate sealed or crushed portions and/or integrated devices for the package.

DETAILED DESCRIPTION OF THE INVENTION

Referring generally to FIGS. 1-25, embodiments of a flexible and hingeable valve mechanism 100 provided with a package or pouch 10 (e.g., flexible) in accordance with the present invention are shown. Embodiments of the package are adapted to contain fluid, such as carbonated liquid C.

Referring to FIGS. 1-6, the package 10 generally includes a front panel portion 12, and a back panel portion 14. Further, a bottom panel portion 15 and a side panel portion 16, both either gusseted or non-gusseted, can be included, especially in those embodiments defining a stand-up package. The joining and/or shaping of the panels 12, 14, 15, 16 generally define an inner cavity having an adjustable internal volumetric capacity. The inner cavity is capable of storing, transporting, and/or dispensing the product or other objects and material therein. The panel portions are often referred to as webs, films, or layers.

References to "top," "bottom," "front," "side," "back" and the like are for illustrative purposes only and are not meant to limit the scope of the disclosed invention.

The package according to the invention can include packages constructed, in whole or in part, of flexible, rigid, semi-rigid, or semi-flexible materials or panels. Briefly, the package panel portions are generally constructed of flexible sheet material such as polyethylene, polyester, metal foil, polypropylene, or polyethylenes or polypropylenes laminated with other materials such as nylon, polyester, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention, in certain embodiments, permits the flexible package to be made using less expensive or cheaper materials than would otherwise be necessary. Various portions or areas of the package or pouch can be constructed of recyclable, compostable, or biodegradable materials.

In various embodiments, the hingeable valve 100 can be formed or made separately and then added or otherwise attached to a portion of the package, such as the top seal area. The separate hingeable valve 100 can be added to the package via heat sealing, adhesives, and the like.

In various embodiments, the front panel portion 12 and the back panel portion 14 will be formed of one contiguous web material. In alternative embodiments, at least one of the panel portions can be distinct web materials joined or sealed to other respective panel portions to form the package 10 of the present invention. For instance, the front panel portion 12 and the back panel portion 14 can be joined to each other from distinct non-contiguous web sheets of material, and one of the panel portions 12-16 can further extend to define the bottom panel portion 15. The bottom panel portion 15 in the various configurations forming a stand-up pouch can include a gusset known to those skilled in the art to further promote operative expansion and contraction of the package 10 and its respective capacity in accordance with the receipt and removal of material within the package 10.

Referring to FIGS. 1-6, embodiments of the present invention include a flexible and hingeable valve mechanism 100 provided or formed in a seal or other portion of the package or pouch 10, e.g., at the top seal 102. The package 10 designs shown in the figures are for illustrative purposes only. The valve mechanism 100 can be employed with a wide variety of pouch or package designs, can be included with or in various seal or non-sealed portions of those pouches.

Referring to FIGS. 4-25, the valve mechanism 100 can include one or more air/gas pressure release channels 102, one or more pockets or pocket elements 104 (e.g., bubble-shaped, bulbous, etc.), and one or more hinge or pinch/kink areas or regions 106. The one or more pockets 104 can be defined by a first/front panel portion **104*a* and a second/back panel portion 104*a*. A portion of the outer perimeter 105 of the one or more pockets can be cut out or otherwise configured to permit the pocket 104 to hinge away from the plane of the top seal 20 or package portion. The structure of the mechanism 100 provides the hingeable pocket 104, thereby providing a working valve that will assist in preventing leaking. When the pouch 10 is filled with carbonated product C and sealed shut, the gas can begin to migrate out of the liquid C and into the top of the pouch. The gas will go to the top of the pouch 10 and fill the pocket 104 in the top seal 20. As the pocket 104 is filled with gas, it can help prevent the top seal 20 from accidentally kinking and allow other gas pressure to flow freely through the one or more channels 102 created within the top seal 20 and located proximate the pocket 104. In general, the figures illustrating the valve mechanism 100 defined in the package with hatching, e.g., FIGS. 4, 7, 9, 11, 13, 15, 17, 19, 21, 23, etc., are cross-section views (e.g., between first and second panel portions of the top seal 20** or other package portions) to show the various valve structures and features.

The pinch or kink areas 106 are configured such that if the pouch 10 is tipped over (e.g., accidentally or intentionally), the pocket 104 will fill with the liquid content C of the pouch and the weight of the liquid C within the pocket 104 will cause it to displace or otherwise fall out of the seal at the hinge 106. This, in turn, will kink or close the one or more channels 102 in the seal 20 near the pocket 104. Once the one or more channels 102 are kinked, the liquid C cannot pass through the one or more channels 102 or leak out of the pouch 10. The areas 106 can include shaped sections, kink lines, structurally weakened pathways (e.g., pressure, heat, etc.), segmented portions, apertures, slits, laser etching, perforations, and the like, to promote hinging and kinking of the one or more channels 102 when the pocket 104 is displaced out away from the package 10 and/or the top seal 20.

Figure 4:
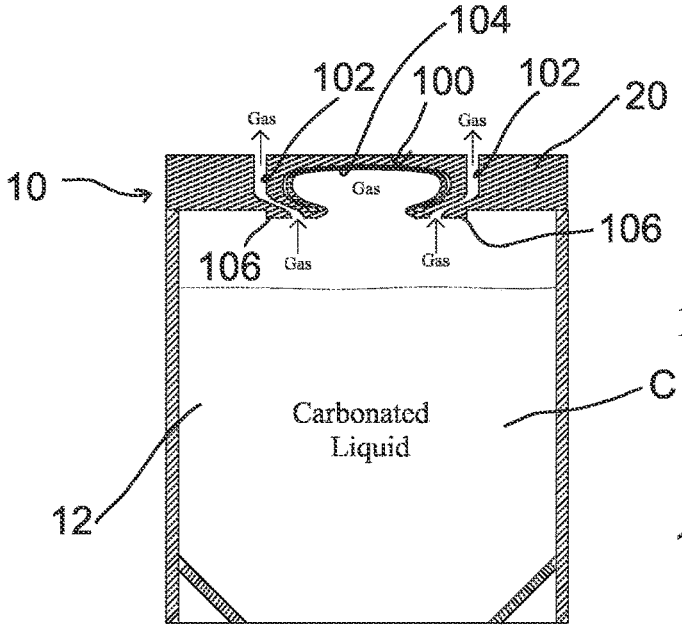
FIGS. 4-6 show a stand-up package having a hingeable valve mechanism in a top seal region, in accordance with embodiments of the present invention.
Figure 5:
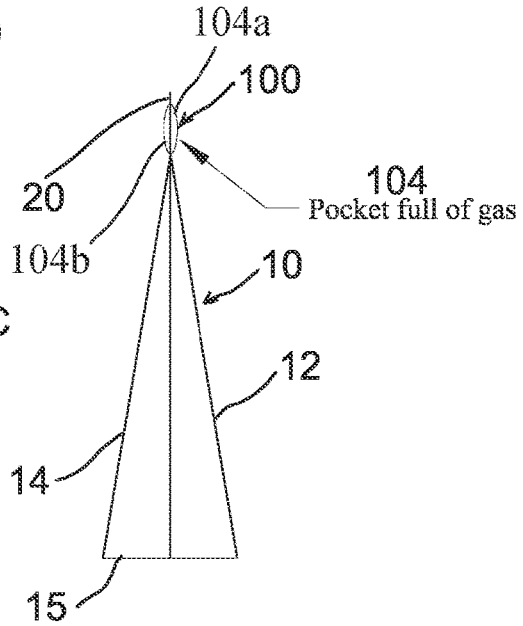
Figure 6:
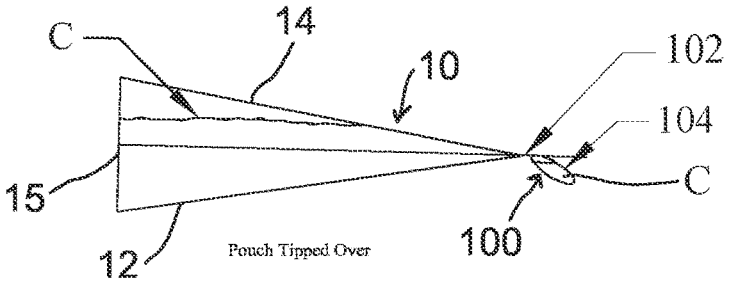

FIGS. 4-6 show an embodiment of the hingeable valve mechanism 100 included with a stand-up pouch 10 configuration. As demonstrated in FIG. 6, and as applicable to other embodiments, the pocket 104 will fill with liquid and hinge at 106 to close off at least a portion of the one or more channels 102 when the pouch 10 is sufficiently tilted or tipped over.

Figure 7:
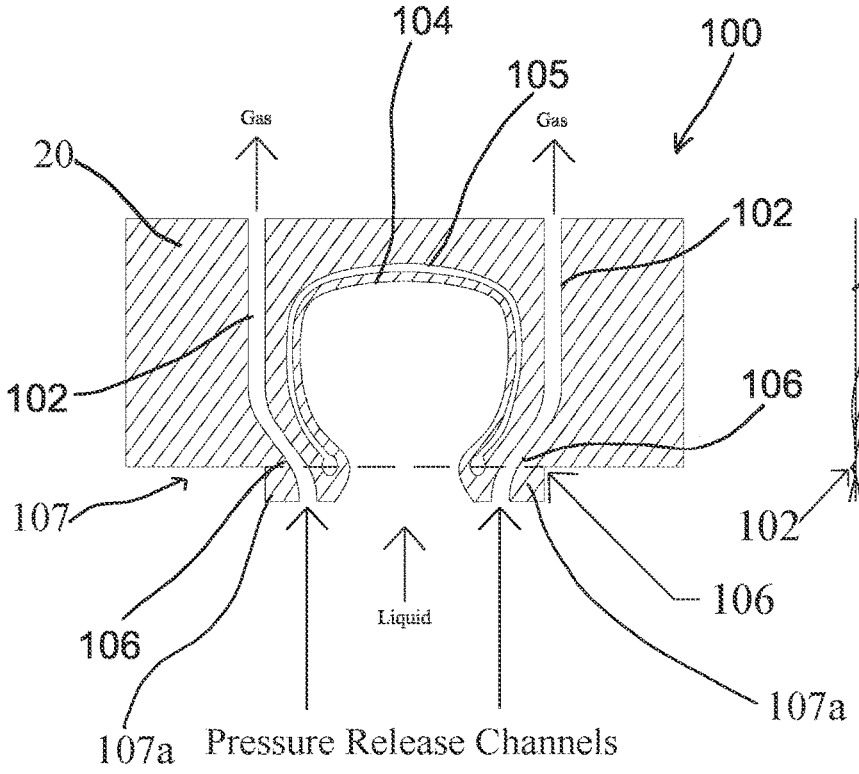
FIGS. 7-16 show exemplary hingeable valve mechanisms having kinking features and pressure release channels, in accordance with embodiments of the present invention.
Figure 8:
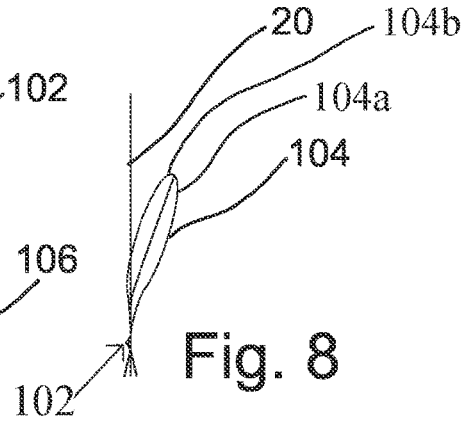

FIGS. 7-8 show an embodiment of the hingeable valve mechanism 100 with channels 102 provided proximate the pocket 104, and a hinge or kink line or area 106 extending along the bottom 107 of the mechanism 100. The kink line 106 can be predefined in the material of the mechanism 100 or seal 20, and can be defined by a weakened pathway, scoring, segmented sections 107*a*, shaped or cut features, etc.

Figure 9:
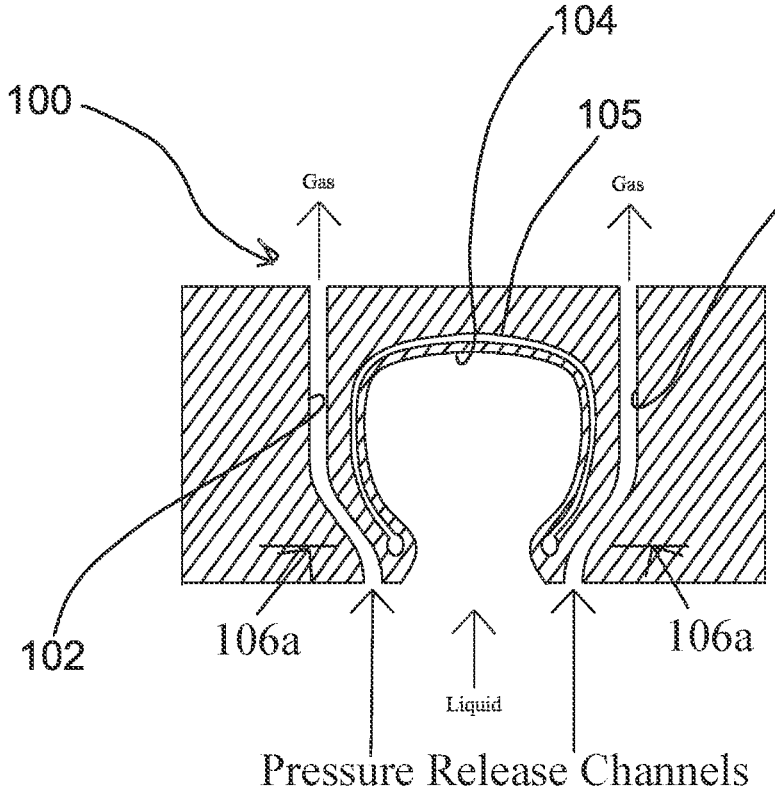
Figure 10:
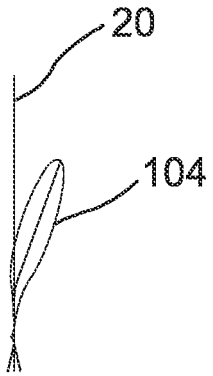

FIGS. 9-10 show an embodiment of the hingeable valve mechanism 100 including one or more slits 106*a* to facilitate hinging or kinking of the air channels 102 provided proximate the pocket 104.

Figure 11:
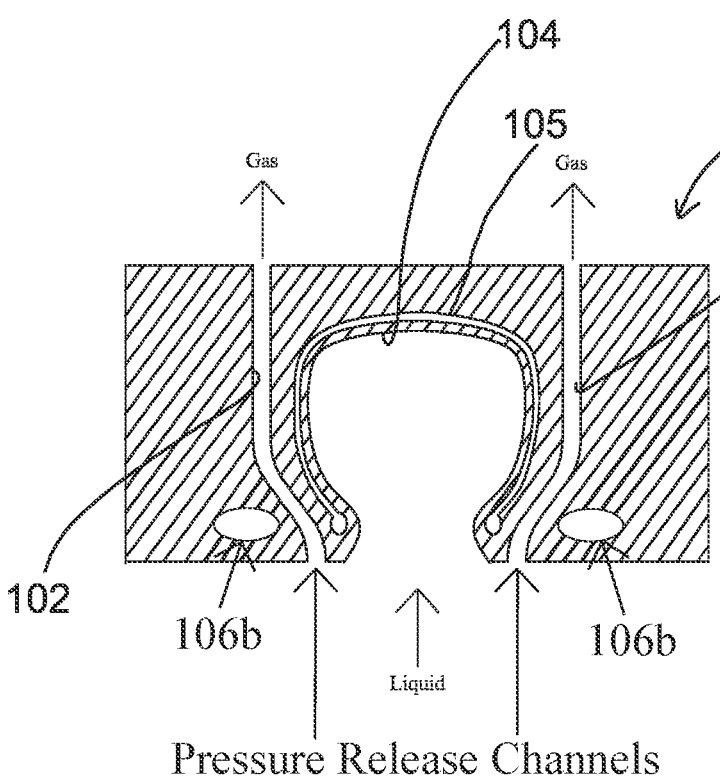
Figure 12:
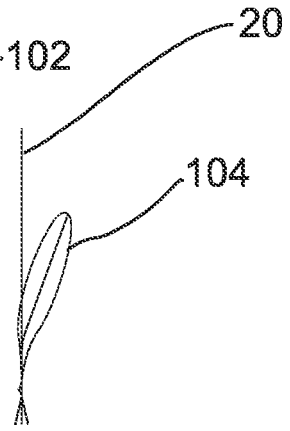

FIGS. 11-12 show an embodiment of the hingeable valve mechanism 100 including one or more apertures or cutouts 106*b* to facilitate hinging or kinking of the air channels 102 provided proximate the pocket 104. The apertures or cutouts 106*b* can take on a myriad of shapes and sizes to facilitate the disclosed kinking.

Figure 13:
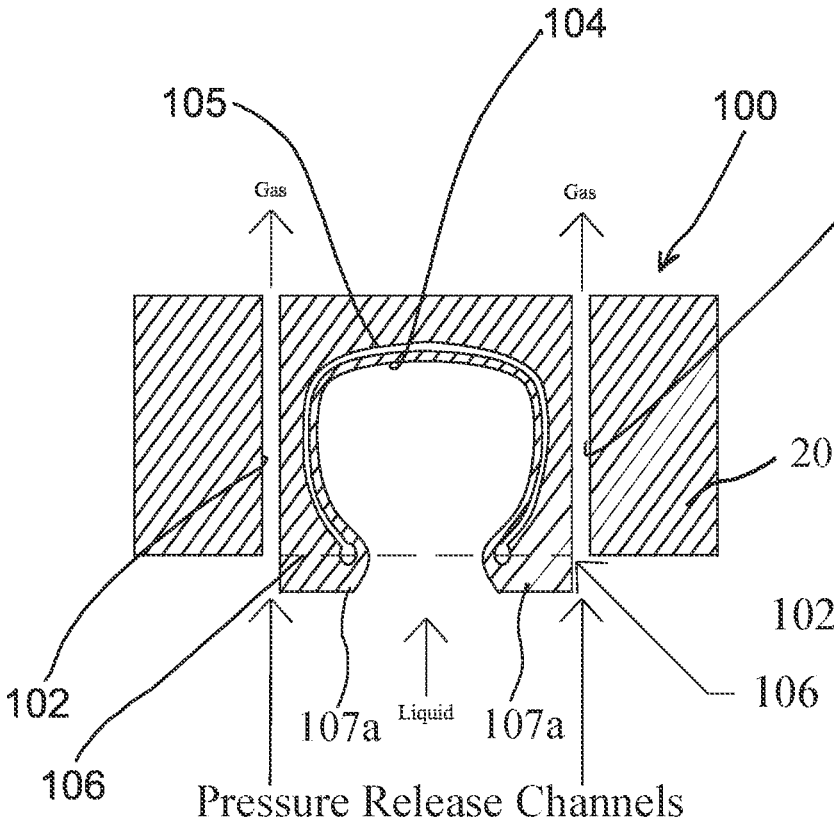
Figure 14:
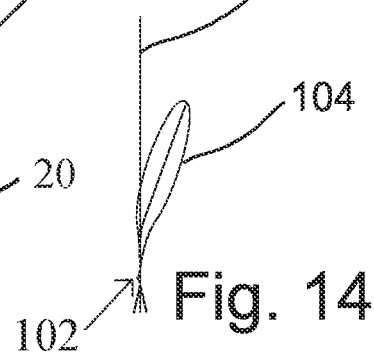
Figures 15, 16:
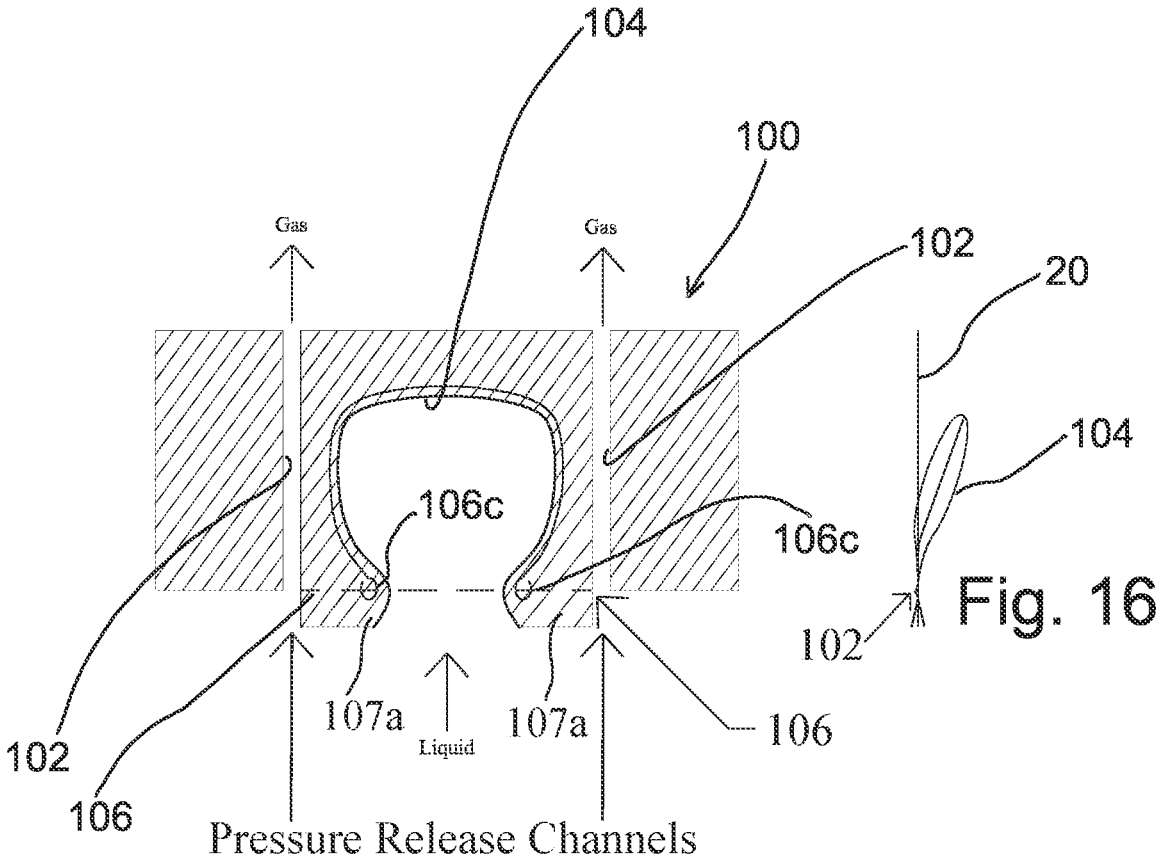

FIGS. 13-16 show embodiments of the hingeable valve mechanism 100 including generally straight or linear air channels 102 and a kink or hinge line 106 and/or feature 106*c* to facilitate hinging or kinking of the air channels 102. Unlike FIGS. 13-14, the material around the pocket 104 perimeter in FIGS. 15-16 is not cut out, in certain embodiments. The pocket 104 of FIGS. 13-14 is, instead, formed or defined with a die cut or similar process. As gas or liquid fills the area, and the front and back panels 104*a*, 104*b* of the pocket 104 start to separate (e g, making room for the gas or liquid), the sides of the pocket 104 will pull inward, making it smaller in diameter. As a result, the pocket 104 will hinge in one direction, away from the rest of the sealed area 20.

Figures 17, 18:
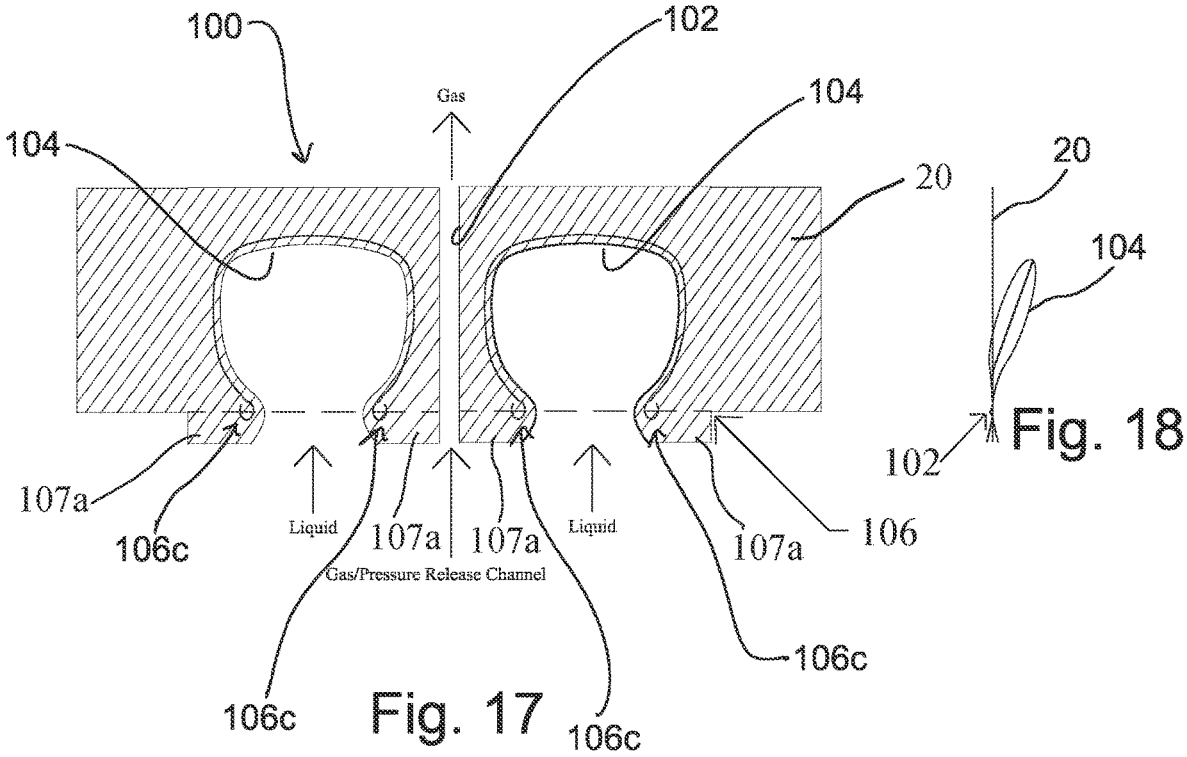
FIGS. 17-18 show a dual pocket hingeable valve mechanism, in accordance with embodiments of the present invention.

FIGS. 17-18 show an embodiment of the hingeable valve mechanism 100 including two pockets 104 and at least one channel 102 provided between those pockets 104. The hinge or kink line 106 and/or feature is provided at the bottom region 107 of the mechanism 100. Further, in certain embodiments, the bottom region 107 of the mechanism 100 can include one or more segmented sections 107*a* (e.g., stopped short of or provided on the sides of the at least one channel 102) to promote kinking.

Figures 19, 20:
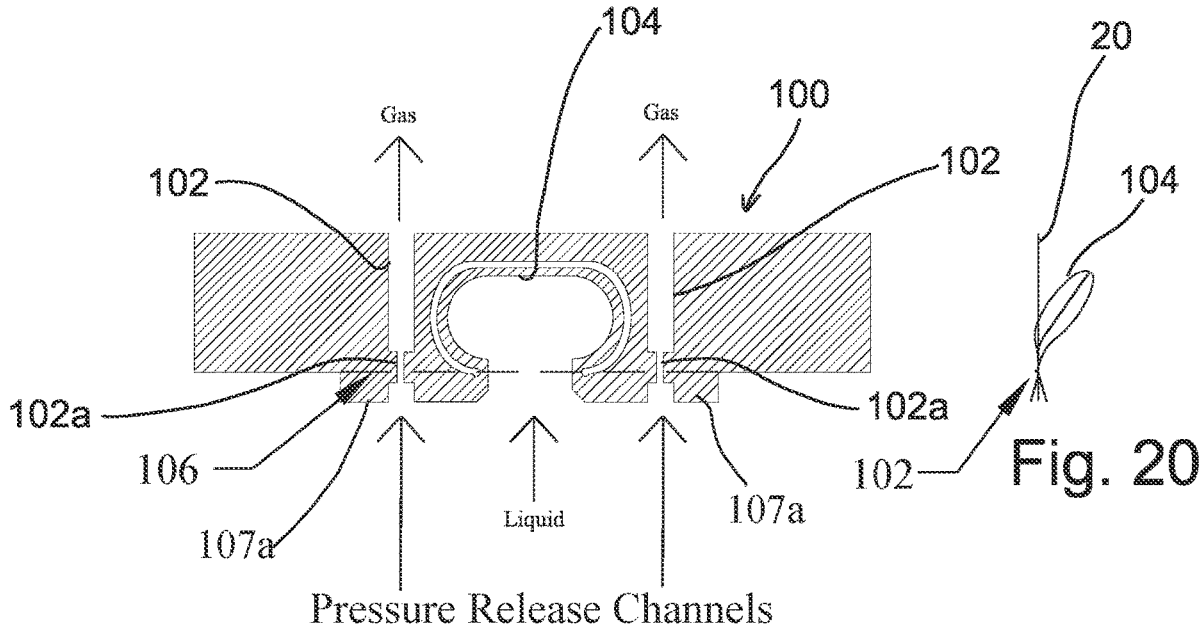
FIGS. 19-25 show exemplary hingeable valve mechanisms having kinking features and pressure release channels, in accordance with embodiments of the present invention.

FIGS. 19-20 show an embodiment of the hingeable valve mechanism 100 including channels 102 having an intermediate narrow section 102*a* extending through the hinge or kink line 106 to facilitate kinking of the channels 102.

Figures 21, 22:
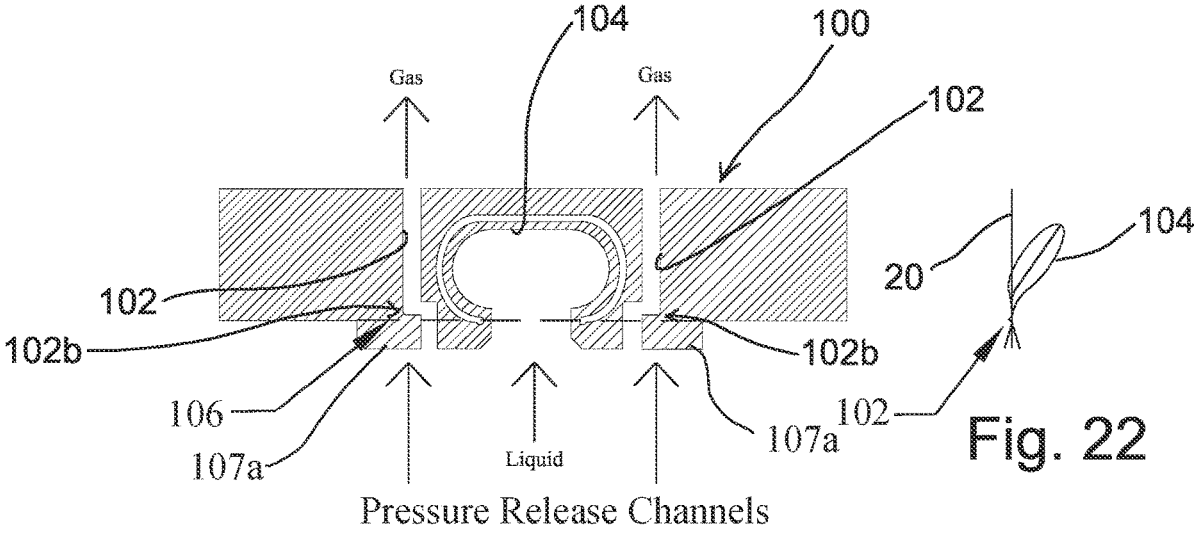

FIGS. 21-22 show an embodiment of the hingeable valve mechanism 100 including channels 102 having a shaped section 102*b* (e.g., transverse sections, curved sections, etc.) proximate or at the hinge or kink line 106 to facilitate kinking of the channels 102.

Figure 23:
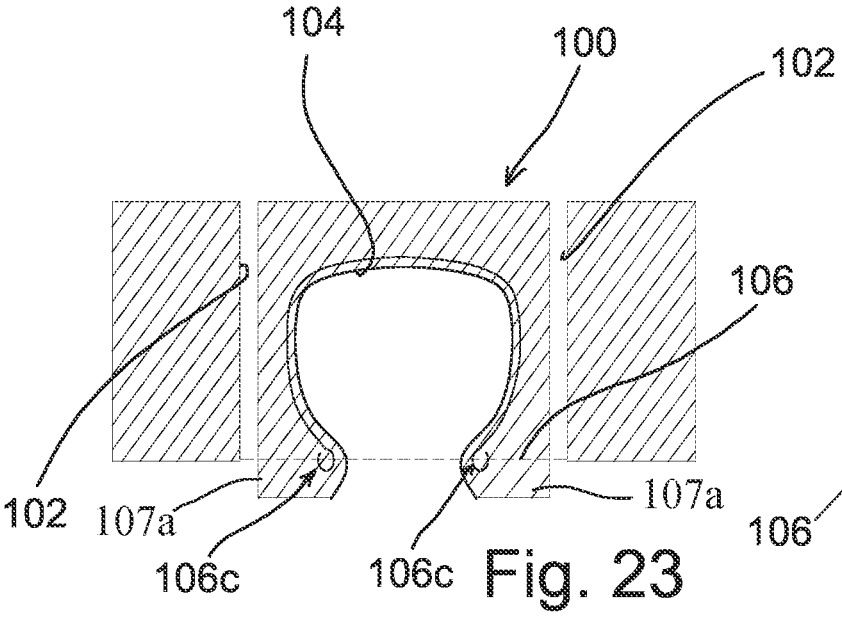
Figure 24:
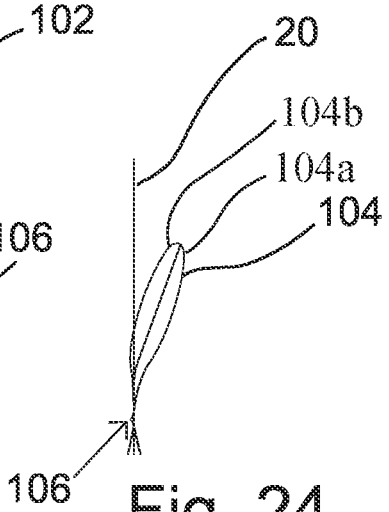
Figure 25:
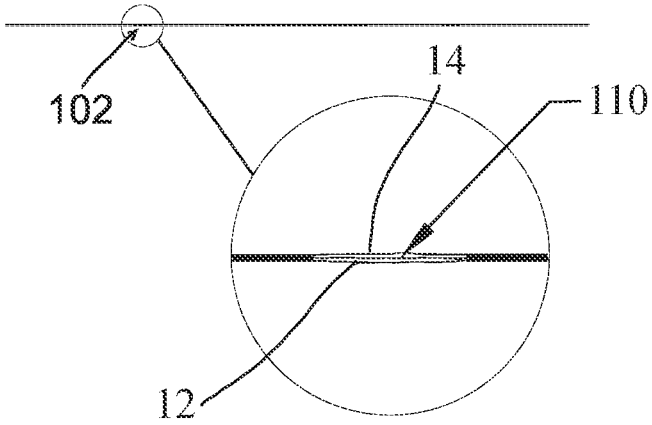

FIGS. 23-25 show an embodiment of the hingeable valve mechanism 100 having one or more layers of film 110 provided between the front panel 102 and back panel 104 of the seal 20, or the first and second panels 104*a*, 104*b* of the pocket, wherein the one or more layers of film 110 are not sealed down in the areas of the channels 102. These one or more layers of film 110 (e.g., sealable poly) provided or buried in between the panels 12, 14, but not sealed in the channels 102, can assist in blocking the channels 102 when they are kinked—e.g., to assist in blocking off fluid when the channel is kinked. The one or more film layers 110 can run through the pocket 104, but this is not necessary with various embodiments.

The package 10 according to the invention can include packages constructed, in whole or in part, of flexible, rigid, semi-rigid, or semi-flexible materials or panels. The packages 10 can include various closure devices, zippers, handles, graphics, and the like.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive packages. Further, features and aspects of the various embodiments described herein can be combined to form additional embodiments within the scope of the invention even if such combination is not specifically described herein.

References to front, back and side panels for the package and package formation embodiments described herein are provided to facilitate an understanding of orientation and direction and are not intended to be limiting. For instance, closure devices, seals, and other structures or portions of the package, can be provided to or along any portion of the package regardless of the references herein to front, back, side, bottom and the like.

What is claimed is:

1. A package, comprising:
- a first panel portion and a second panel portion;
- one or more seals formed at least in a portion of the first panel portion;
- a hingeable valve mechanism defined in the one or more seals and including;
  - one or more hingeable pocket elements configured to receive a liquid product;
  - one or more gas channels provided proximate the one or more hingeable pocket elements; and
  - one or more kinkable areas configured to close off a portion of the one or more gas channels upon displacement of the one or more hingeable pocket elements away from the one or more seals when the one or more hingeable pocket elements include the liquid product.

2. The package of claim 1, wherein the one or more hingeable pocket elements include two hingeable pocket elements.

3. The package of claim 1, wherein the one or more gas channels include a first gas channel provided on a first side of the one or more hingeable pocket elements and a second gas channel provided on a second side of the one or more hingeable pocket elements.

4. The package of claim 1, where the one or more gas channels include an arcuate portion.

5. The package of claim 1, wherein the one or more gas channels include a generally linear portion.

6. The package of claim 1, wherein the one or more gas channels include a narrowed channel portion proximate or at the kinkable areas.

7. The package of claim 1, wherein the one or more kinkable areas include one or more slits.

8. The package of claim 1, wherein the one or more kinkable areas include one or more apertures.

9. The package of claim 1, wherein the one or more kinkable areas include one or more hinge lines.

10. The package of claim 1, wherein the one or more kinkable areas include one or more arcuate features.

11. The package of claim 1, further including one or more film layers extending into and not sealed within the one or more gas channels.

12. The package of claim 1, wherein the one or more kinkable areas include a channel extending transverse from the one or more gas channels.

13. A package, comprising:

a first panel portion and a second panel portion;

a hingeable valve mechanism defined in at least one of the first and second panel portions, and including;

one or more hingeable pocket elements configured to receive a liquid product;

one or more gas channels provided proximate the one or more hingeable pocket elements; and one or more kinkable areas configured to close off a portion of the one or more gas channels upon displacement of the one or more hingeable pocket elements when the one or more hingeable pocket elements include the liquid product.

14. The package of claim 13, wherein the one or more hingeable pocket elements include two hingeable pocket elements.

15. The package of claim 13, wherein the one or more gas channels include a first gas channel provided on a first side of the one or more hingeable pocket elements and a second gas channel provided on a second side of the one or more hingeable pocket elements.

16. The package of claim 13, where the one or more gas channels include an arcuate portion.

17. The package of claim 13, wherein the one or more kinkable areas include one or more slits.

18. The package of claim 13, wherein the one or more kinkable areas include one or more apertures.

19. The package of claim 13, wherein the one or more kinkable areas include one or more hinge lines.

20. The package of claim 13, further including one or more film layers extending into and not sealed within the one or more gas channels.

* * * * *